US009624763B2

(12) United States Patent
Samuelson et al.

(10) Patent No.: US 9,624,763 B2
(45) Date of Patent: Apr. 18, 2017

(54) DOWNHOLE HEALTH MONITORING SYSTEM AND METHOD

(71) Applicants: Marc N. Samuelson, Houston, TX (US); Christian F. Bayne, The Woodlands, TX (US); David S. Bishop, Houston, TX (US)

(72) Inventors: Marc N. Samuelson, Houston, TX (US); Christian F. Bayne, The Woodlands, TX (US); David S. Bishop, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 271 days.

(21) Appl. No.: 14/499,494

(22) Filed: Sep. 29, 2014

(65) Prior Publication Data

US 2016/0090833 A1 Mar. 31, 2016

(51) Int. Cl.

| | |
|---|---|
| ***E21B 47/01*** | (2012.01) |
| ***E21B 47/00*** | (2012.01) |
| ***E21B 47/12*** | (2012.01) |
| ***E21B 17/02*** | (2006.01) |

(52) U.S. Cl.
CPC ..... *E21B 47/00* (2013.01); *E21B 17/028* (2013.01); *E21B 47/12* (2013.01)

(58) Field of Classification Search
CPC ..... E21B 47/01; E21B 17/028; E21B 47/00; E21B 47/12; E21B 17/021; E21B 19/16
See application file for complete search history.

(56) References Cited

U.S. PATENT DOCUMENTS 4,293,936 A 10/1981 Cox et al.
4,782,897 A * 11/1988 Zeller ..... E21B 23/006 166/240
4,783,995 A 11/1988 Michel et al.
(Continued)

FOREIGN PATENT DOCUMENTS

CA 2305259 A1 4/2000
WO 0133044 A1 5/2001

OTHER PUBLICATIONS

International Search Report and Written Opinion; International Application No. PCT/US2015/046793; International Filing Date: Aug. 25, 2015; Date of Mailing: Nov. 23, 2015; 10 pages.

*Primary Examiner* — Francis Gray
(74) *Attorney, Agent, or Firm* — Cantor Colburn LLP

(57) ABSTRACT

A method of installing multi-trip completions in a borehole. The method includes interfacing a health monitoring system with a first section of the multi-trip completions, the health monitoring system configured to engage with at least one of a first control line and first equipment of the first section. Running the health monitoring system and the first section downhole to a selected position within the borehole; storing information about a health of the at least one of the first control line and first equipment of the first section within the health monitoring system. Removing the health monitoring system from the borehole while leaving the first section within the borehole; accessing the information from the health monitoring system; and, determining, based on the information, whether or not to run a second section having a second control line into the borehole. The second control line configured to connect with the first control line.

20 Claims, 5 Drawing Sheets

(56) References Cited

U.S. PATENT DOCUMENTS

| | | | | |
|---|---|---|---|---|
| 4,919,201 | A | 4/1990 | Bridges et al. | |
| 5,058,683 | A | 10/1991 | Godfrey et al. | |
| 5,252,832 | A | 10/1993 | Nguyen et al. | |
| 5,309,405 | A | 5/1994 | Brett et al. | |
| 5,360,066 | A | 11/1994 | Venditto et al. | |
| 5,386,875 | A | 2/1995 | Venditto et al. | |
| 5,410,152 | A | 4/1995 | Gadeken | |
| 5,443,119 | A | 8/1995 | Chambers et al. | |
| 5,570,437 | A | 10/1996 | Kluth et al. | |
| 5,577,559 | A | 11/1996 | Voll et al. | |
| 5,579,842 | A | 12/1996 | Riley | |
| 5,582,064 | A | 12/1996 | Kluth | |
| 5,667,023 | A | 9/1997 | Harrell et al. | |
| 5,723,781 | A | 3/1998 | Pruett et al. | |
| 5,767,411 | A | 6/1998 | Maron | |
| 5,789,662 | A | 8/1998 | Dayal | |
| 5,804,713 | A | 9/1998 | Kluth | |
| 5,875,852 | A | 3/1999 | Floyd et al. | |
| 5,892,176 | A | 4/1999 | Findlay et al. | |
| 5,892,860 | A | 4/1999 | Maron et al. | |
| 5,925,879 | A | 7/1999 | Hay | |
| 6,041,860 | A * | 3/2000 | Nazzal | E21B 23/002 166/250.01 |
| 6,367,323 | B1 * | 4/2002 | Camwell | E21B 21/08 73/152.03 |
| 6,983,796 | B2 | 1/2006 | Bayne et al. | |
| 7,537,061 | B2 | 5/2009 | Hall et al. | |
| 8,074,720 | B2 | 12/2011 | Radi | |
| 8,739,884 | B2 | 6/2014 | Lake | |
| 2004/0251027 | A1 * | 12/2004 | Sonnier | E21B 31/00 166/297 |
| 2005/0077086 | A1 * | 4/2005 | Vise, Jr. | E21B 49/081 175/59 |
| 2005/0222772 | A1 | 10/2005 | Koederitz et al. | |
| 2009/0299654 | A1 | 12/2009 | Garvey et al. | |
| 2010/0300684 | A1 | 12/2010 | Kotsonis et al. | |
| 2011/0083845 | A1 | 4/2011 | McLaughlin et al. | |
| 2011/0214883 | A1 | 9/2011 | Patel | |
| 2012/0130642 | A1 | 5/2012 | Reckmann | |
| 2013/0076525 | A1 * | 3/2013 | Vu | E21B 41/00 340/853.1 |
| 2013/0255947 | A1 | 10/2013 | Frisby et al. | |

* cited by examiner

DOWNHOLE HEALTH MONITORING SYSTEM AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

When the borehole is to be completed in sections or intervals, a lower completion or isolation assembly is first run into the borehole, and then subsequently an upper completion is run in the borehole and connected to the lower completion, such as by using a wet connector. Commonly the lower completion or isolation assembly is run in on service equipment (running tool, packer setting tool, etc.) deployed on a service tubing string or drillpipe. The service string or drillpipe is not generally deployed with a control line to surface, so the equipment below the running tool has no connection to surface. When intelligent completions systems are deployed in the borehole, the intelligent equipment in the lower completion or isolation string is run-in "blind" and the lower completion is not connected to surface until after the upper completion is connected to the lower completion. Such intelligent completions systems can include fiber optic, hydraulic, and electric connections.

The art would be receptive to improved devices and methods for downhole intelligent completions systems.

BRIEF DESCRIPTION

A method of installing multi-trip completions in a borehole, the method includes interfacing a health monitoring system with a first section of the multi-trip completions, the health monitoring system configured to engage with at least one of a first control line and first equipment of the first section; running the health monitoring system and the first section downhole to a selected position within the borehole; storing information about a health of the at least one of the first control line and first equipment of the first section within the health monitoring system; removing the health monitoring system from the borehole while leaving the first section within the borehole; accessing the information from the health monitoring system; and, determining, based on the information, whether or not to run a second section having a second control line into the borehole, the second control line configured to connect with the first control line.

A multi-trip completions system includes a first section having at least one of a first control line and first equipment; a health monitoring system configured to interface with the first section and to store information regarding a health of the at least one of the first control line and first equipment, the health monitoring system independent from surface control; and, a second section having at least one second control line, the second section configured to connect with the first section after the health monitoring system is disconnected from the first section.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
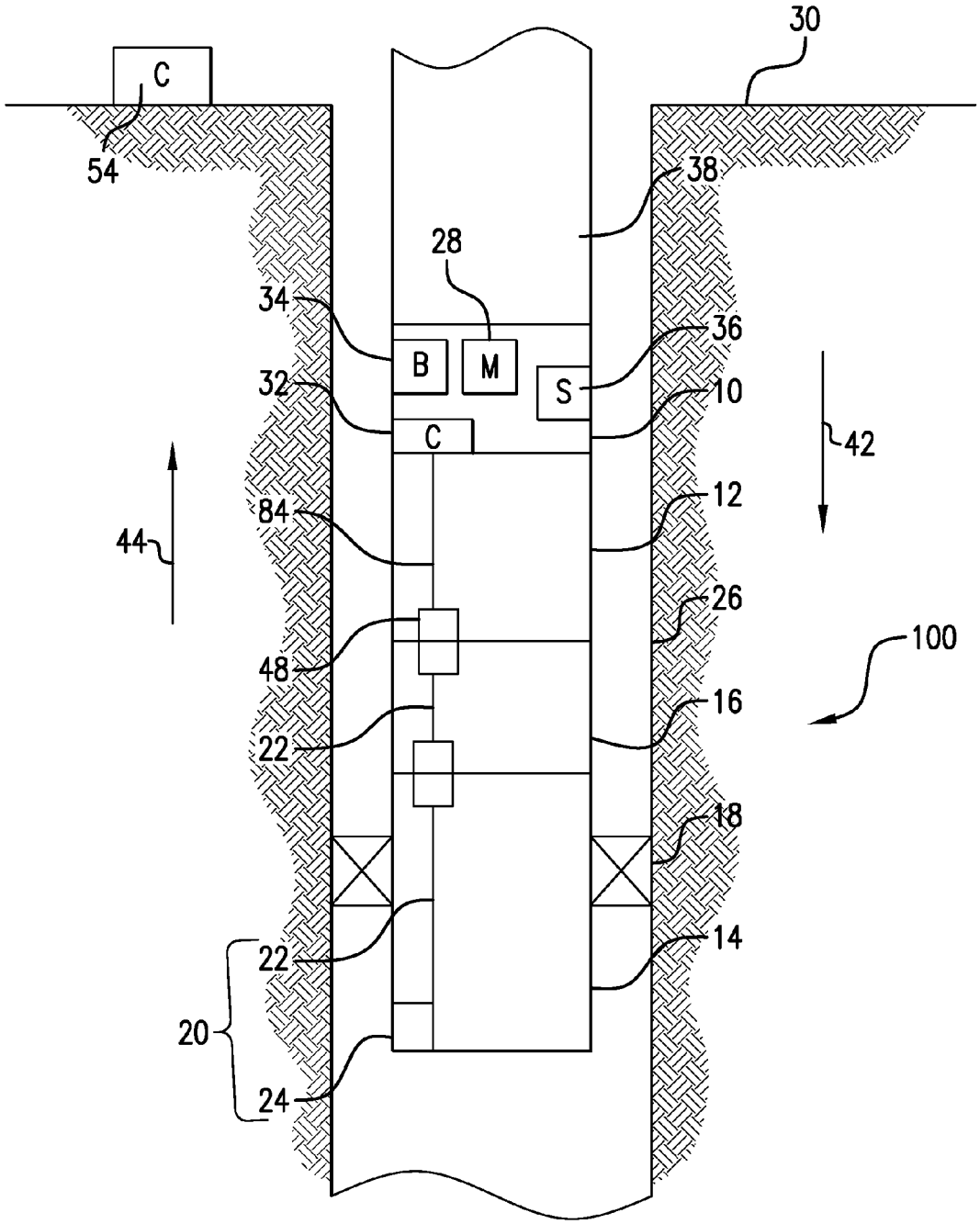
FIG. 1 depicts a cross-sectional and schematic view of an exemplary embodiment of a health monitoring system employed downhole with a first section of a multi-trip completions system.
Figure 2:
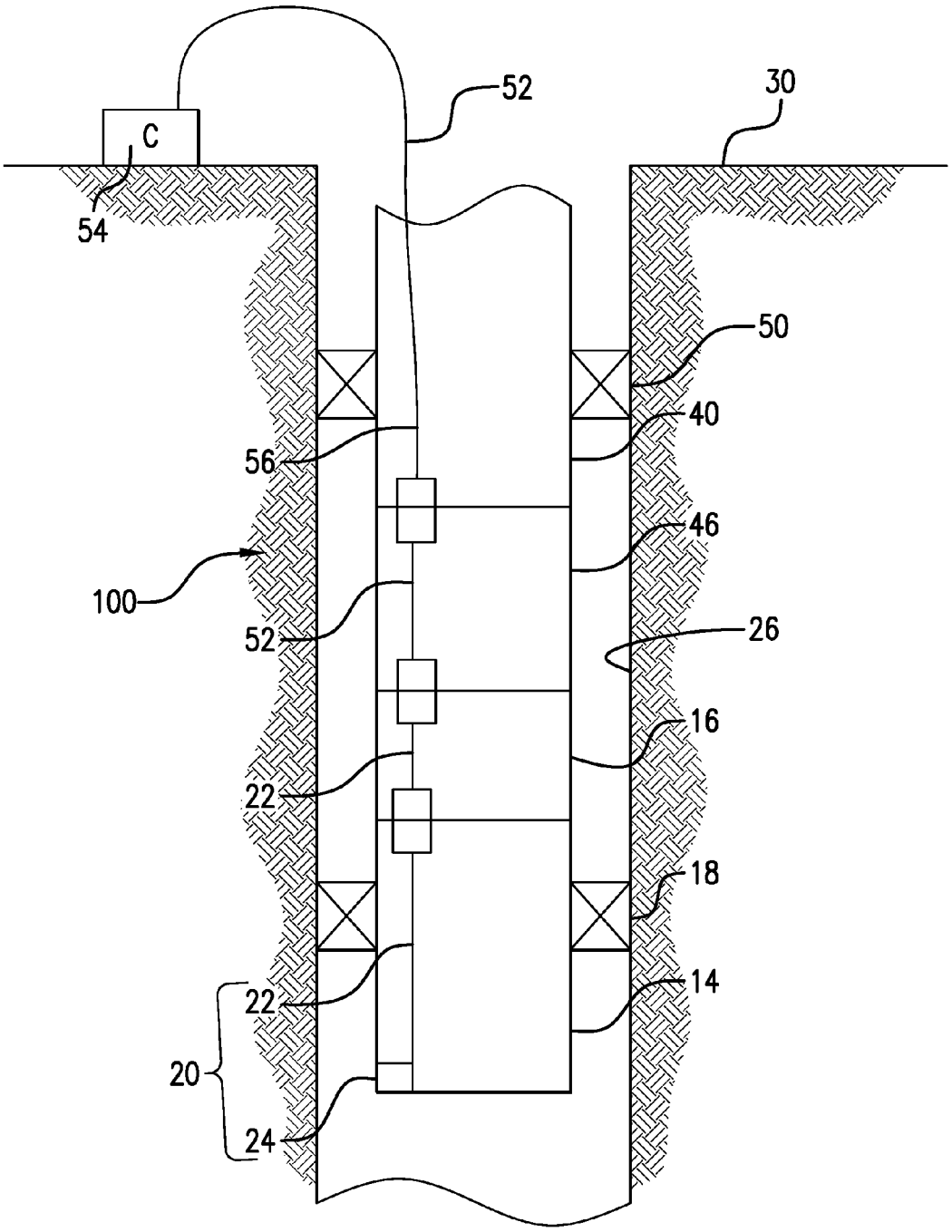
FIG. 2 depicts a cross-sectional and schematic view of an exemplary embodiment of the multi-trip completions system.
Figure 3:
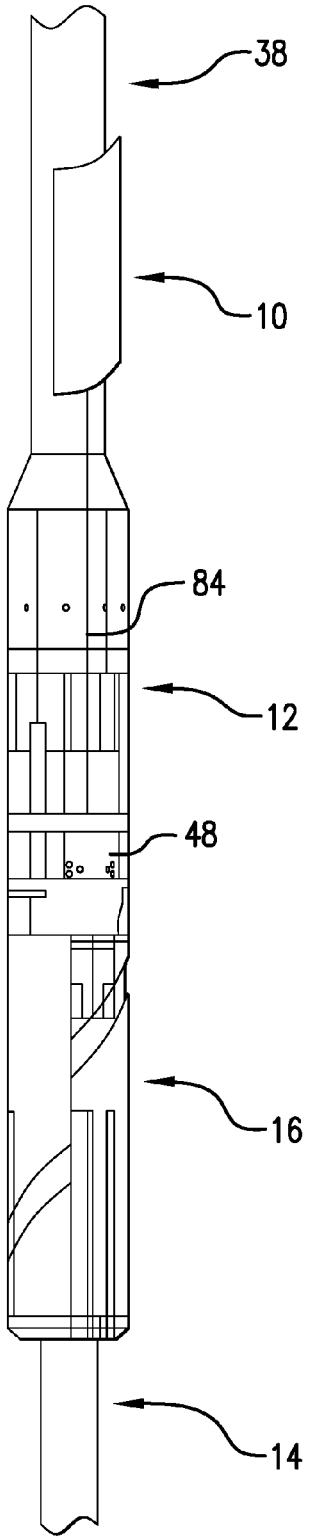
FIG. 3 depicts a cross-sectional view of an exemplary embodiment of the health monitoring system of FIG. 1 employed downhole with a running tool and wetmate connector of a multi-trip completions system.
Figure 4:
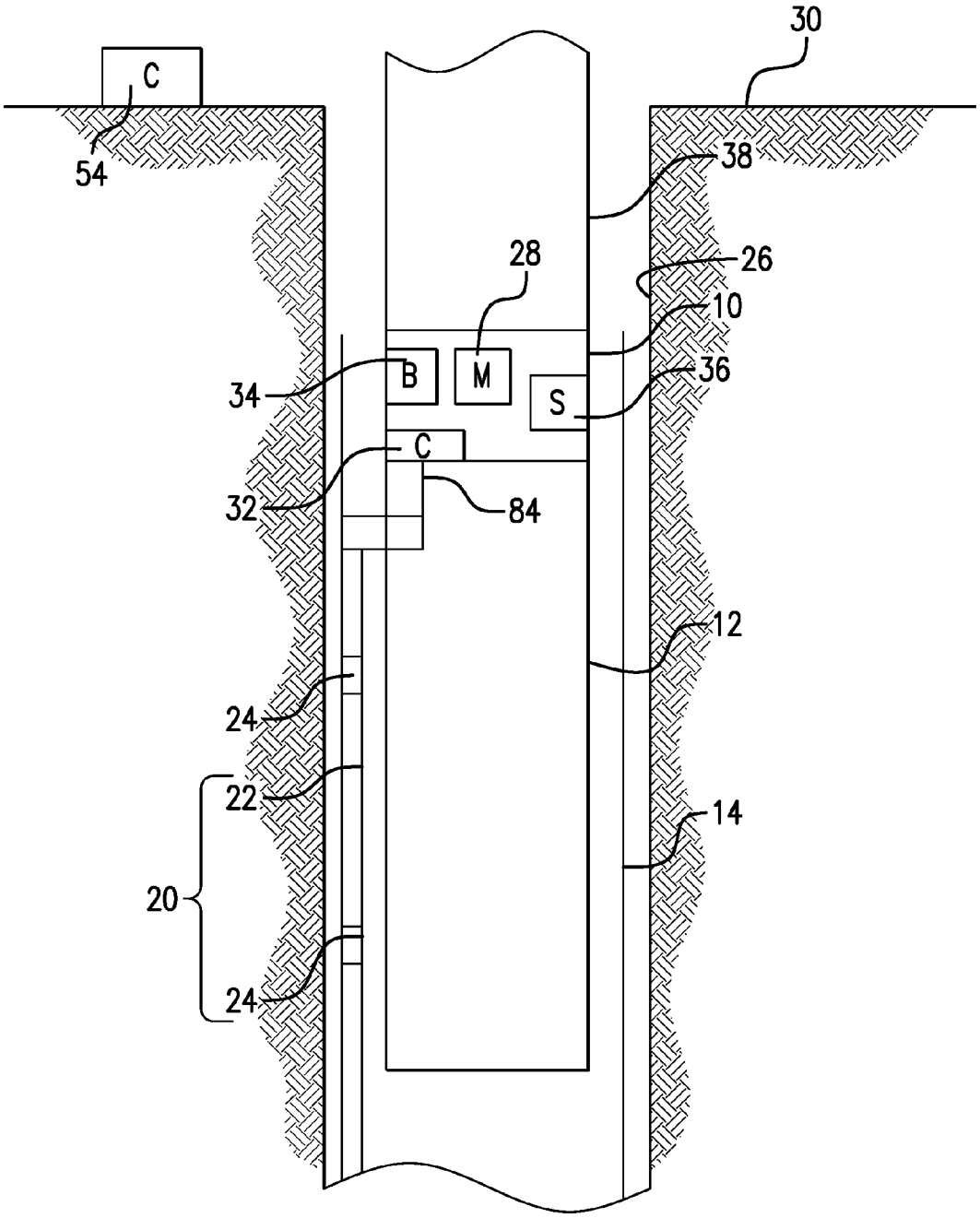
FIG. 4 depicts a cross-sectional and schematic view of an exemplary embodiment of a health monitoring system employed downhole within a first section of a multi-trip completions system; and, FIG. 5 depicts a cross-sectional view of an exemplary embodiment of a first section for a multi-trip completions system and an exemplary embodiment of a re-connect anchor for a health monitoring system.

With reference to FIGS. 1-4, exemplary embodiments of a device and method of running intelligent production systems ("IPS") equipment 20 within a multi-trip completions system 100 in a borehole 26 include the use of an autonomous health monitoring system 10 for ensuring the "health" of first installed IPS equipment 20 prior to miming and installing second IPS equipment 56 that attaches to the first equipment 20. The health of the IPS equipment 20 refers to whether the IPS equipment 20 is damaged or operatively functional. As shown in FIGS. 1 and 3, an exemplary embodiment of the health monitoring system 10 may be provided in conjunction with a service string or running tool 12 for a lower completion or isolation assembly, shown schematically as lower section or first section 14. The running tool 12, as shown in FIG. 3, may carry a lower wetmate connector, or first wetmate connector 16, as well as the lower completion, or first section 14 or concentric tubing. The first wetmate connector 16 can be a stand-alone item or integrated into a packer 18, and/or combined with the first section 14. Also, while the first section 14 is depicted as downhole of the running tool 12, the running tool 12 and/or the health monitoring system 10 may alternatively be positioned internally of the first section 14, such as in the case of a concentric tubing and an isolation assembly, such as shown in FIG. 4.

The health monitoring system 10 interrogates the IPS equipment 20 in the first section 14, shown schematically as at least one first control line 22 and/or at least one first intelligent device 24 such as, but not limited to, a sensor or control that is connected to the first control line 22. While the control line 22 and the device 24 are depicted internally within the first section 14, these items may also be on an external surface of the first section 14, or between layers of the first section 14. The health monitoring system 10 is configured to function without requiring a connection to surface 30. The health monitoring system 10 will monitor and/or log significant parameters related to the surveillance, control system or other IPS equipment 20 of the first section 14 that is being run in a borehole 26 and store the information in a storage section, such as a memory 28, of the health monitoring system 10. For example, if the IPS equipment 20 is arranged in the first section 14 for detecting a parameter such as temperature, but the health monitoring system 10 does not receive any monitored information from the IPS equipment 20 with regards to temperature, then an operator will determine, after the health monitoring system 10 has been brought to surface 30, that the IPS equipment 20 is damaged. That is, if the health monitoring system 10 does not receive monitored or logged information from the IPS equipment 20, then an operator at surface 30 can determine that the health of the IPS equipment 20 is not operatively functional.

Alternatively or additionally, the health monitoring system 10 may include a controller 32 that sends a one time or periodic test signal inquiry to each control line 22, such as an electrical signal to determine if the IPS equipment 20 responds appropriately, and the IPS equipment 20 may be configured to respond with a specific test signal response. In the case where the control line 22 is an optical fiber, the controller 32 can include an optical transmitter and receiver to test the optical fiber. In the case of a hydraulic control line 22, the controller 32 may check the pressure within the hydraulic control line 22 to see if it compares with an expected pressure, and the health monitoring system 10 may further optionally include a small supply of fluid for a pressure test. Thus, the health monitoring system 10 is configured to test the health, whether operatively functional or damaged, of each control line 22 and/or other related IPS device 24. Because the health monitoring system 10 is not connected to surface 30, a battery 34 may be utilized within the health monitoring system 10 if needed for power. Sensors 36 may further be included in the health monitoring system 10 for assessing various downhole parameters of the borehole environment at the selected location of the first section 14, such as, but not limited to, pressure and temperature, or may include sensors 36 configured to detect water. Logged readings from these sensors 36 can be used to compare with logged readings from the IPS device 24 (if the health monitoring system 10 is configured to receive logged readings from the IPS device 24) or can be used as an additional source of information. The stored information in the memory 28 can be analyzed once workstring 38, health monitoring system 10, and running tool 12 are pulled out of the borehole 26.

The health monitoring system 10 would allow saving monitoring information from the IPS equipment 20 deployed in the first section 14 before an upper completion or second section 40 is deployed, as shown in FIG. 2. That is, after the first section 14 is run into the borehole 26 (in downhole direction 42), the running tool 12, workstring 38, and health monitoring system 10 are pulled in an uphole direction 44 to surface 30, leaving the first section 14 and first wetmate connector 16, if employed, within the borehole 26. An operator at the surface 30 is then provided with access to information as to the status of the IPS equipment 20 in the first section 14, before the second section 40 is run-in-hole in the downhole direction 42 through the borehole 26 to connect to the first section 14 that is already in place within the borehole 26, such as via packers 18 and/or anchors. If the first section 14 is deemed operatively functional or otherwise deemed healthy, a determination can then be made to run the second section 40 downhole to connect with the first section 14, such as by connecting an upper wetmate connector or second wetmate connector 46, secured or integrated with a downhole end of the second section 40, to the first wetmate connector 16 that may be secured to or integrated with an uphole end of the first section 14. If a wetmate connector 16 is employed, the running tool 12 may include a third wetmate connector 48 that is also connectable to the first wetmate connector 16. While the use of first and second wetmate connectors 16, 46 are shown, alternatively, the first and second sections 14, 40 may be directly connected to each other and the health monitoring system 10 may directly connect to the first connector 16 through the running tool 12 or service tool rather than through the first and third wetmate connectors 16, 48. Or, alternatively, the wetmate connectors 16, 46, may be integrated into packers 18, 50, and the health monitoring system 10 may connect to the first section 14 through packer 18, in which case the first control line 22 would extend through packer 18.

When the health monitoring system 10 is installed as shown in FIGS. 1, 3, and 4 it can be used to assess health of components within the first section 14 including hydraulic, electric or fiber optic components 20 therein. When connected to the first section 14, if the health monitoring system 10 is able to receive an electrical or optical signal or achieve a fluid connection through a hydraulic conduit, this information can be stored in the health monitoring system 10 and later assessed by an operator at the surface 30 as an indication of a functional first section 14, in particular functional IPS equipment 20. The health monitoring system 10 could also be used to record monitored downhole parameters (temperature, pressure, etc.) in the borehole 26 prior to pulling the workstring 38, health monitoring system 10, and running tool 12 uphole, such as via one or more sensors 36. When the information regarding health of equipment 20 and/or downhole parameters is accessed and read or otherwise analyzed/interpreted at surface 30, the information can be used to adjust a subsequent procedure of landing the second section 40 onto the first section 14 and bringing the well online. For example, it may be determined that the hydraulic, electric, and/or fiber optic components 20 within the first section 14 are damaged, and therefore instead of running the second section 40 downhole to connect with the first section 14, the first section 14 may be pulled uphole for repair, or a service string may be run downhole if the damaged component 20 in the first section 14 can be repaired while downhole. Thus, running the second section 40 to connect with damaged components of a first section 14 is a frustrating and expensive experience that can be avoided through the use of the health monitoring system 10 described herein. The health monitoring system 10 would provide for a method of confirming the health of the intelligent equipment 20 deployed in the first section 14 prior to running the second section 40, thus reducing the financial risks of running complex monitoring and other intelligent equipment 20 in deep wells.

Exemplary embodiments of the health monitoring system 10 may be part of the service string/running tool 12 that would interface with the intelligent completions equipment 20 in the first section 14 and record data associated with the health of the intelligent completion system 20 of the first section 14. After the first section 14, lower completion equipment or isolation string, is installed, and the running tool 12 is retrieved, the information on the health of the intelligent completion equipment 20 stored in the health monitoring system 10 can be investigated at surface 30. This will provide information as to the health status of the first section 14, and the borehole parameters. Without this information the entire second section 40 (upper completion) must be run-in-hole and connected to the first section 14 (lower completion), as shown in FIG. 2, before determining whether the equipment 20 in the first section 14 sustained any damage during run-in. With this health monitoring system 10, if there is damage to the equipment 20 on the first section 14, a decision can be made based on that information to run the second section 40 or to try to attempt to repair or retrieve the first section 14.

While a method of using the health monitoring system 10 has been described in relation to determining the health of a first section 14 to assess whether or not to connect a second section 40 thereto, the health monitoring system 10 may also be used in a fishing or intervention job in which the tool interfacing with the health monitoring system 10 would take data that could then be retrieved when the tool was brought back to the surface 30.

Figure 5:
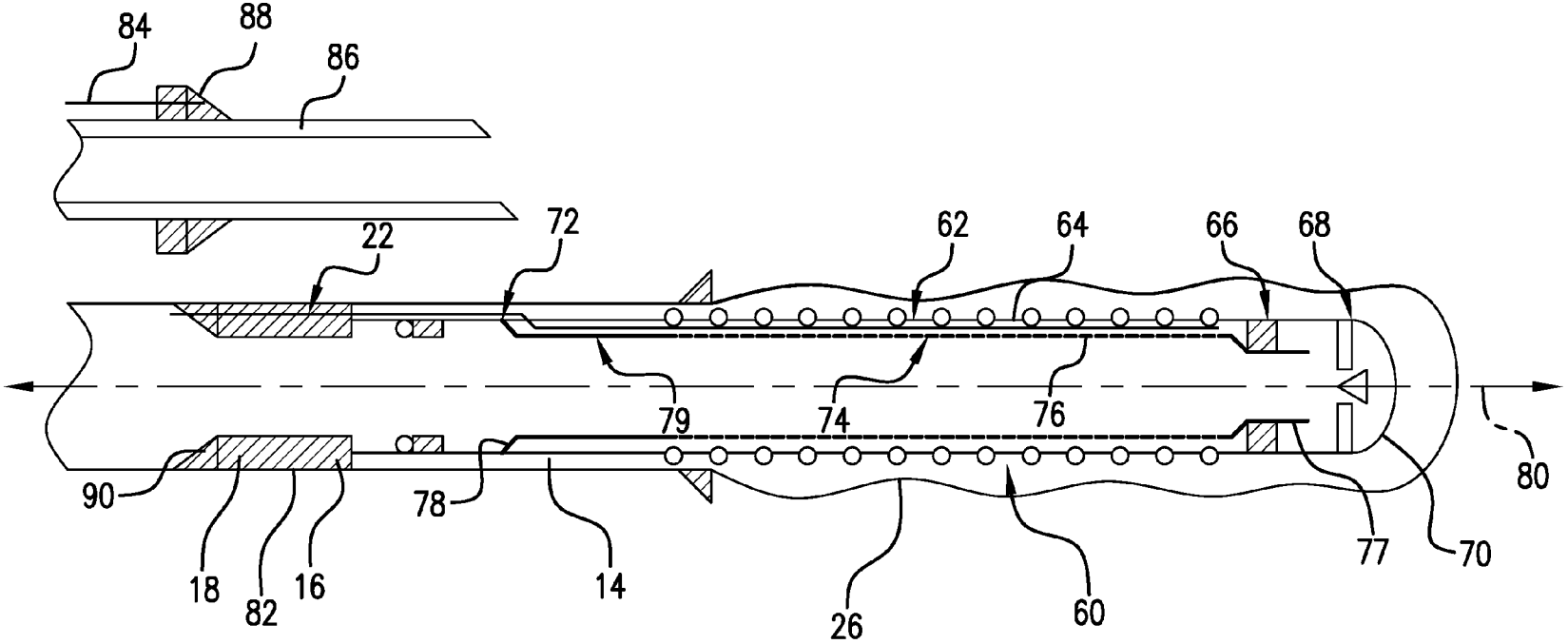

An exemplary first section 14 is shown in FIG. 5. The first section 14 is a lower completion that includes a gravel pack assembly 60. The gravel pack assembly 60 includes a shroud assembly 62 with an external perforated shroud 64, and an O-ring seal sub 66 near a downhole end 70 of the gravel pack assembly 60. A set shoe 68 is provided between the O-ring seal sub 66 and the downhole end 70. A landing nipple may be provided adjacent an uphole end of the shroud assembly 62 for a quick connect 72 to a screen assembly 74. The screen assembly 74 is seated internally within the shroud assembly 62, with a downhole end 77 of the screen assembly 74 extending through the O-ring seal sub 66 and an uphole end 78 of the screen assembly 74 connected to the shroud assembly 62 such as at the quick connect coupling 72. The screen assembly 74 further includes one or more gravel pack screens 76 and a portion of blank pipe 79. The screen assembly 74 and shroud assembly 62 can be assembled at surface 30 without rotation and with one or more control lines 22. The control lines 22 may extend longitudinally as shown, substantially parallel to a longitudinal axis 80 of the gravel pack assembly 60. Alternatively, the control lines 22 may extend down to the O-ring seal sub 66 and further turn and loop back up through the liner top packer 82, which may be the combined packer 18 and first wetmate connector 16 previously described. The control lines 22 may also extend helically between the screen assembly 74 and the shroud assembly 62. The gravel pack assembly 60 may then be run into place with the liner top packer 82 using running tool 12 and workstring 38 (FIGS. 1, 3). Communication with the gravel pack assembly 60 may be made through the control lines 22, which may be conduits, electrical control lines, and/or fiber optics, which extend through the packer 82 and between the shroud assembly 62 and screen assembly 74. Additional details regarding a gravel pack assembly 60 may be found in U.S. Pat. No. 6,983,796, which is herein incorporated by reference in its entirety.

Prior to running a production string or other upper completion (second section 40 as shown in FIG. 2) into connection with the gravel pack assembly 60 shown in FIG. 5, the health of the control lines 22 within the gravel pack assembly 60 can be ascertained during the running and positioning of the gravel pack assembly 60 into the borehole 26 using the health monitoring system 10 (FIGS. 1 and 3) which is attached via control line connectors 84 to an exemplary embodiment of a re-connect anchor 86 shown in FIG. 5. The re-connect anchor 86 may include a second mating portion 88 that seats within or otherwise mates with a first mating portion 90 of the packer 82. The re-connect anchor 86 may be a wetmate connector 48 as previously described, or may be a portion of the running string 12. In any case, the health monitoring system 10 of FIGS. 1, 3, and 4 connects the control line connector 84 to the control line 22 for monitoring and storing information about the health of the gravel pack assembly 60, and in particular about the IPS equipment 20 within the gravel pack assembly 60. After the gravel pack assembly 60 is positioned at the selected location within the borehole 26, the health monitoring system 10, running tool 12, and re-connect anchor 86 may be disconnected from the packer 82 and gravel pack assembly 60 and brought to surface 30 to read the information stored by the health monitoring system 10. If the control lines 22 or other IPS equipment 20 of the gravel pack assembly 60 are determined to be functional, then the production string (second section 40) may then be run downhole such that second control lines 52 of the second section 40 are connected with control lines 22 of the gravel pack assembly 60 via the packer 82.

Thus, the health monitoring system 10 is incorporated within a running tool 12 or service string to connect, such as via third wetmate connectors 48, 86 in or connected to the running tool 12/service string, to the first section 14, such as via the first wetmate connector 16, 82 of the first section 14. The health monitoring system 10 can log monitored information from the first section 14 to be downloaded and checked after it is pulled out of the borehole. The running tool 12 carries the first wetmate connector 16 and the first section 14 during deployment of the first section 14 into the borehole 26. The first section 14 may include saleables, such as a concentric string as in the case of the isolation assembly or could be screens, isolation devices, etc. of a standard lower completion, including the surveillance and/or control IPS equipment 20 integrated therein and monitored by the health monitoring system 10 during deployment, for later readings on surface 30 after the health monitoring system 10 is brought to surface 30. The health monitoring system 10 is independent of a control system 54 at surface 30, however the first section is connected to the control system 54 when the second section 40 is connected to the first section 14, such as via the second control line 52 which is connected to the control system 54. By not connecting the health monitoring system 10 to surface 30 during run-in of the first section 14, the health monitoring system 10 can be easily incorporated into running tools 12 and service strings, the expense of the health monitoring system 10 is significantly lowered, and the potential for damage of the health monitoring system 10 is limited. Since the running tools 12 and service strings are returned to surface 30 prior to run in of the second section 40, the opportunity to review the health of the first section 14 is advantageously taken prior to running the second section 40 by using the health monitoring system 10 described herein.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of installing multi-trip completions in a borehole, the method comprising:

interfacing a health monitoring system with a first section of the multi-trip completions, the health monitoring system configured to engage with a equipment including a first control line and a device of the first section;

running the health monitoring system and the first section into the borehole in a downhole direction to a selected position within the borehole;

storing information about a health of at least one of the first control line and the device of the first section within the health monitoring system;

removing the health monitoring system from the borehole while leaving the first section within the borehole;

accessing the information from the health monitoring system; and, determining, based on the information, whether or not to run a second section having a second control line into the borehole, the second control line configured to connect with the first control line.

2. The method of claim 1, wherein interfacing a health monitoring system with a first section includes connecting the first section to a running tool, the health monitoring system integrated with the running tool.

3. The method of claim 2, wherein interfacing a health monitoring system with a first section further includes connecting the running tool to a wetmate connector on the first section.

4. The method of claim 2, wherein running the health monitoring system and the first section into the borehole in a downhole direction to a selected position within the borehole includes running the health monitoring system, running tool, and first section downhole together to the selected position.

5. The method of claim 1, wherein removing the health monitoring system from the borehole includes bringing the health monitoring system to a surface location of the borehole, and accessing the information at the surface location.

6. The method of claim 1, wherein storing information about a health of the at least one of the first control line and the device of the first section within the health monitoring system includes storing monitored information from the at least one of the first control line and the device in the first section, and further comprising analyzing the monitored information to determine if the at least one of the first control line and the device is operatively functional or damaged.

7. The method of claim 1, further comprising using the health monitoring system to test the at least one of the first control line and the device of the first section, and storing information about a health of the at least one of the first control line and the device of the first section within the health monitoring system includes storing information about whether the at least one of the first control line and the device is operatively functional or damaged.

8. The method of claim 1, wherein determining, based on the information, whether or not to run a second section having a second control line into the borehole, includes determining not to run the second section if the at least one of the first control line and the device is damaged and determining to run the second section downhole to the first section if the at least one of the first control line and the device is operatively functional.

9. A multi-trip completions system comprising:

a first section having at least one of a first control line and a device;

a health monitoring system configured to interface with the first section and to store information regarding a health of the at least one of the first control line and the device, the health monitoring system independent from surface control; and, a second section having at least one second control line, the second section configured to connect with the first section after the health monitoring system is disconnected from the first section.

10. The multi-trip completions system of claim 9, wherein information regarding a health of the at least one first control line and the device includes information regarding if the at least one of the first control line and the device is damaged or operatively functional.

11. The multi-trip completions system of claim 9, wherein the health monitoring system further includes a battery.

12. The multi-trip completions system of claim 9, wherein the health monitoring system further includes at least one sensor configured to detect at least one of temperature and pressure.

13. The multi-trip completions system of claim 9, further comprising a first wetmate connector connected to the first section, a second wetmate connector connected to the second section, the first and second wetmate connectors configured to connect the at least one first control line to the at least one second control line.

14. The multi-trip completions system of claim 9, further comprising a running tool, the health monitoring system connected to the running tool, the running tool configured to deliver the first section downhole with the health monitoring system.

15. The multi-trip completions system of claim 14, wherein the health monitoring system is connected to the at least one first control line through the running tool via a control line connection.

16. The multi-trip completions system of claim 14, further comprising a first wetmate connector connected to the first section, a second wetmate connector connected to the second section, the first and second wetmate connectors configured to connect the at least one first control line to the at least one second control line, and a third wetmate connector connected to the running tool, the third wetmate connector configured to connect to the first wetmate connector and configured to connect the at least one first control line to the health monitoring system.

17. The multi-trip completions system of claim 9, wherein the health monitoring system is configured to be internal to the first section.

18. The multi-trip completions system of claim 9, further comprising a control system at a surface location of a borehole in which the first section is disposed, wherein the health monitoring system is disconnected from the control system when disposed in the borehole with the first section, and the at least one first control line is in communication with the control system when the at least one first control line is connected to the at least one second control line.

19. The multi-trip completions system of claim 9, wherein the first section includes a gravel pack assembly.

20. The multi-trip completions system of claim 9, further comprising a test signal deliverable by the health monitoring system to the at least one of the first control line and the device.

* * * * *